US005219310A

United States Patent [19]

Tomo et al.

[11] Patent Number: 5,219,310

[45] Date of Patent: Jun. 15, 1993

[54] METHOD FOR PRODUCING PLANAR ELECTRON RADIATING DEVICE

[75] Inventors: Yoichi Tomo; Hidetoshi Watanabe, both of Tokyo, Japan

[73] Assignee: Sony Corporation, Tokyo, Japan

[21] Appl. No.: 852,000

[22] Filed: Mar. 13, 1992

[30] Foreign Application Priority Data

Mar. 13, 1991 [JP] Japan ..... 3-072198

[51] Int. Cl.[5] ..... H01J 9/12; H01J 1/30

[52] U.S. Cl. ..... 445/24; 445/51; 313/309; 313/336

[58] Field of Search ..... 445/24, 50, 51; 313/336, 351, 309

[56] References Cited

U.S. PATENT DOCUMENTS 3,789,471 2/1974 Spindt et al. ..... 445/50

3,998,678 12/1976 Fukase et al. ..... 445/24

FOREIGN PATENT DOCUMENTS 53-94760 8/1978 Japan ..... 445/51

*Primary Examiner*—Richard K. Seidel

*Assistant Examiner*—Jeffrey T. Knapp

[57] ABSTRACT

A method for producing a planar type electron radiating device including a plurality of cathodes having pointed ends on a major surface of a substrate, and a gate electrode having holes in the vicinity of the cathodes, is disclosed. After a hole is formed in the gate electrode and a silicon oxide film for laying a part of the major surface of the substrate to outside, a chromium thin film as a tight metal bonding film is deposited on the bottom of the hole prior to formation of the cathode, and the cathode is formed on the chromium thin film to prevent the cathode from being detached during the production process.

9 Claims, 4 Drawing Sheets

METHOD FOR PRODUCING PLANAR ELECTRON RADIATING DEVICE

BACKGROUND OF THE INVENTION

This invention relates to a method for producing a planar type electron radiating device used for a flat panel display and, more particularly, to a flat type electron radiating device for radiating electrons from a plurality of pointed end cathodes.

As an image display device to take the place of the currently employed CRT for a television receiver, investigations are presently conducted into a planar type image display device. Such planar type image display device may be exemplified by a liquid crystal display, an electroluminescence device and a plasma display panel. A field emission type image display device is also attracting attention in respect of display luminosity on the viewing screen surface.

The field emission type image display device is now explained briefly. A number of conically-shaped cathodes of molybdenum etc. with a diameter of not more than 1.0 μm, formed on a substrate by a semiconductor producing process, are used as radiation sources, and a plate-shaped gate electrode, provided with holes in register with the cathodes, are formed at the distal ends of the cathodes. The gate electrode is spaced apart from the distal ends of the cathodes and a high electrical voltage is applied across the gate electrode and the cathodes to produce field emission to extract an electron beam from the cathodes. This electron beam is irradiated on light emitting particles (phosphors) arranged on the back side of an anode to display a desired picture. Such field emission type image display device is described for example in U.S. Pat. No. 3,665,241, and the method for producing an electron radiating device, in which cathodes are formed on a substrate, is disclosed for example in JP Patent KOKOKU Publication No. 1-294336 (1989).

The known methods for producing an electron radiating device by arraying a plurality of pointed-end cathodes employed in the field emission type image display device suffer from a drawback that the cathodes tend to be detached from the substrate.

That is, with the known methods, an insulating film is formed on the substrate, and a gate electrode layer is formed in the insulating layer. The gate electrode layer and the insulating film are removed in regions thereof in which to form the cathodes, so that the major surface of the substrate is exposed at the bottom of the so-formed holes. A cathode electrode material is then deposited on the sidewall of the holes formed in the gate electrode layer by an oblique vacuum deposition technique to produce the pointed-end cathodes.

However, if ultrasonic cleaning is carried out for peeling off any excess cathode electrode material, the cathodes deposited on the major surface of the substrate are detached to render it difficult to radiate the electron beam.

OBJECT AND SUMMARY OF THE INVENTION

It is a principal object of the present invention to provide a method for producing a planar type electron radiating device wherein the cathodes may be prevented from becoming detached during the production process to improve the production yield.

In accordance with the present invention, there is provided a method for producing a planar type electrode planar device including a substrate on the major surface of which a plurality of cathodes with pointed ends are formed, and a gate electrode having a plurality of holes in the vicinity of said cathodes, said method comprising forming a tight metal bonding film on said major surface before forming said cathodes on said major surface.

For the tight metal bonding film, chromium or a metal exhibiting tight bonding properties equivalent thereto may be employed. The tight metal bonding film is of a film thickness of an order of 500 Å and preferably in the range of from 100 to 300 Å.

In accordance with the present invention, by forming the tight metal bonding film to a thin thickness on the major substrate surface, tight bonding between the major substrate surface and the cathodes is improved to prevent the cathodes from becoming detached from the major substrate surface.

Other objects and advantages of the present invention will become apparent from the following description.

DESCRIPTION OF THE PREFERRED EMBODIMENT

Figure 1:
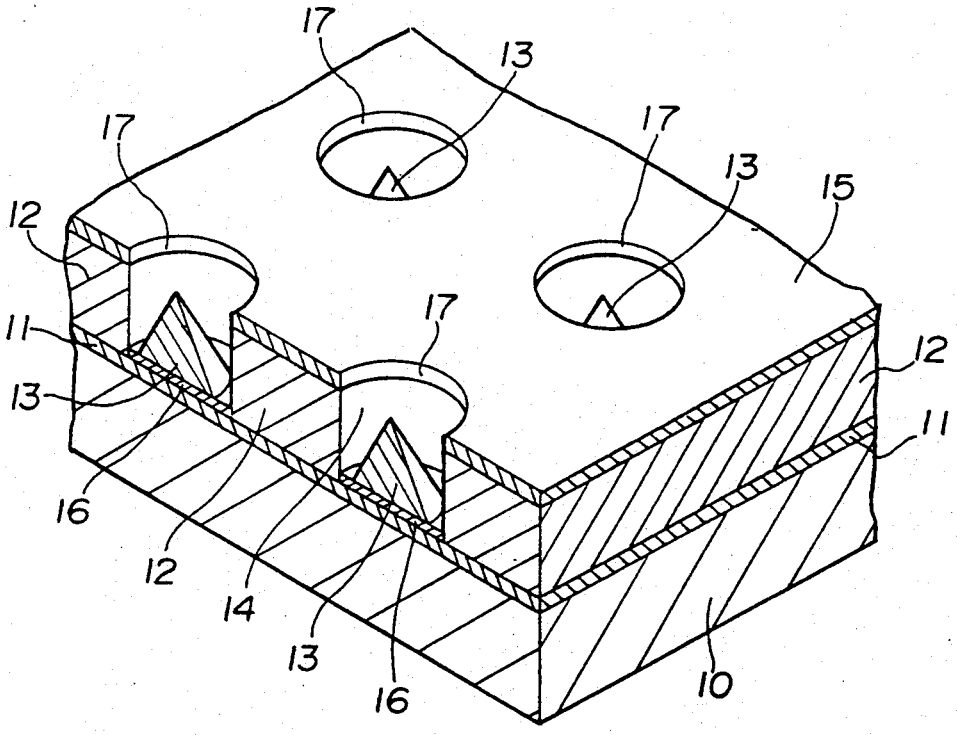
FIG. 1 is a partial cross-sectional perspective view of a planar electron radiating device produced by the method of the present invention.

Referring first to FIG. 1, the construction of a planar type electron radiating device, produced by the method according to the present invention, is briefly explained.

Referring to FIG. 1, showing the planar type electron radiating device, produced by the method of the present invention, an electrical voltage supplying layer 11 is formed on a substrate 10, which is a glass or silicon base late coated with e.g. a silicon oxide film. A silicon oxide film 12 is formed on the voltage supplying layer 11, and a plurality of holes 14 are formed above the voltage supplying layer 11 in regions in which to form cathodes 13. A gate electrode layer 15 formed on the silicon oxide layer 12 is also provided with holes 17 in register with the holes 14.

Each cathode 13 is in the form of a cone having a pointed end and is formed within the inside of each hole 14 from a material such as molybdenum or tungsten. A thin chromium film 16 is formed on the surface of the electrical voltage supplying layer 11 as a bonded metal film, before formation of the cathode 13, for suppressing detachment of the cathode 13. The cathodes are arrayed on the major surface of the substrate 11 in a two-dimensional matrix configuration and are each of a height of a submicron order. The chromium thin film 16 for improving tight bonding of the cathode 13 is of a thickness less than about 500 Å and preferably of an order of 100 to 300 Å.

The substrate provided with an array of a number of cathodes 13 in this manner is faced by an anode electrode, not shown, and a phosphor layer provided on the anode electrode radiates light by an electron beam radiated from the cathodes 13 to effect image display.

The method for producing the planar type electron radiating device according to the present invention is hereinafter explained step by step by referring to FIGS. 2 to 8.

Figure 2:
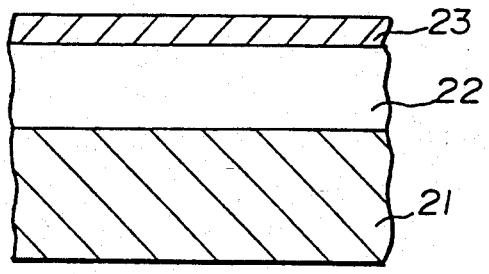
FIG. 2 is a cross-sectional view showing the method for producing the planar electron radiating device and showing the process up to the stage of formation of a gate electrode layer.
Figure 3:
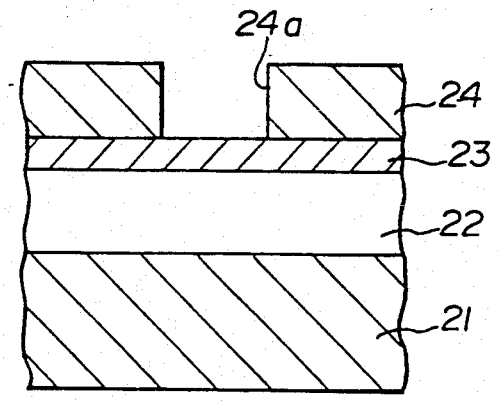
FIG. 3 is a cross-sectional view showing the method for producing the planar electron radiating device and showing the process up to the stage of formation of a resist pattern of a resist layer.
Figure 4:
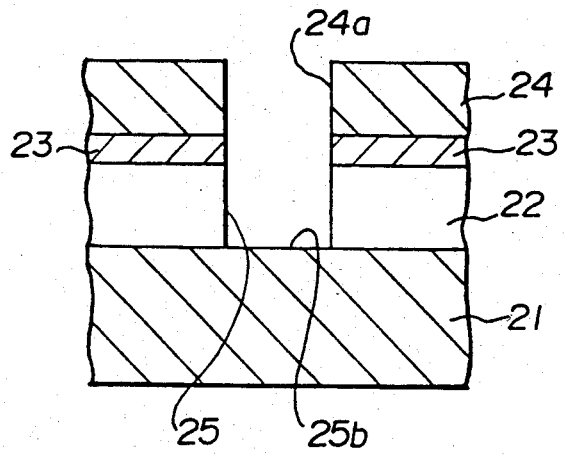
FIG. 4 is a cross-sectional view showing the method for producing the planar electron radiating device and showing the process up to the stage of formation of an opening.
Figure 5:
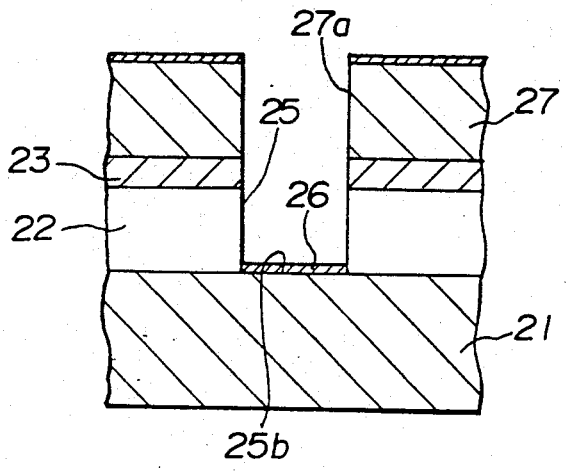
FIG. 5 is a cross-sectional view showing the method for producing the planar electron radiating device and showing the process up to the stage of formation of a chromium thin layer.
Figure 6:
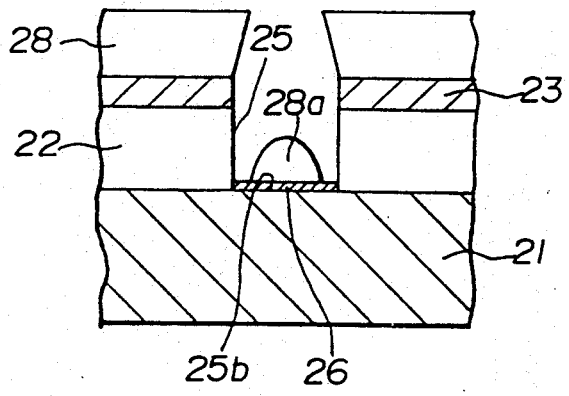
FIG. 6 is a cross-sectional view showing the method for producing the planar electron radiating device and showing the process up to the stage of formation of a layer of a first cathode electrode material.

A silicon oxide film 22 as an interlayer insulating film is formed on the entire surface of a substrate 21. Although not shown, a cathode voltage supplying layer is formed on the substrate 21. The film thickness of the silicon oxide layer 22 is used as a measure of the distance between the gate electrode and the distal end of a cathode. A gate electrode layer 23 is formed on the entire surface of the silicon oxide film 22, as shown in FIG. 2. The gate electrode layer 23 is formed of a metallic material, such as molybdenum or tungsten.

After formation of the gate electrode layer 23, a resist layer 24 for patterning is coated on the entire surface of the layer 23. The resist layer 24 is developed by being selectively exposed to light. The resist pattern of the developed resist layer 24 is such a pattern in which regions thereof in which to form the cathodes are removed and the surface of the gate electrode layer 23 is exposed at the bottom of a so-formed opening 24.

Etching is then performed, using the patterned resist layer 24 as a mask. By this etching, the gate electrode layer 23 is selectively removed after the pattern of the resist layer 24, and further the silicon oxide film 22 is also selectively removed after the pattern of the resist layer 24 or the pattern of the gate electrode 23. After selective removal of the gate electrode layer 23 and the silicon oxide film 22, a hole 25 is formed in a region in which to form the cathode. The major surface of the substrate 21 is exposed at a bottom **25*b* of the opening 25. The resist layer 24** used for the patterning is peeled off and removed.

After the hole 25 is formed above the major surface of the substrate 21, a resist layer 27 is formed on the entire surface and developed by selective exposure to light after the same pattern as that of the resist layer 24 to form a window **27*a*. The opening 25 is located at the bottom of the window 27*a* and the major surface of the substrate is exposed at a bottom 25*b* of the hole 25. Meanwhile, it is not absolutely necessary to remove the resist layer 24. After forming such resist layer 27, the thin chromium layer 26 as a tight metal bonding layer is formed to a thin thickness on the bottom 25*b* of the hole 25. This thin chromium layer 26, which is a film onto which the cathode now to be formed is bonded tightly, is deposited on the major surface of the substrate by e.g. electron beam deposition or evaporation by resistance heating. This chromium thin film 26 is of an extremely thin thickness of e.g. 500 Å or less and preferably of the order of 100 to 300 Å. The chromium thin film 26 on the resist layer 27 is removed with peeling off of the resist layer 27, so that only the chromium thin film 26 deposited on the bottom 25*b* of the hole 25** is left.

After the chromium thin film 26 for improving tight bonding is formed on the bottom of the hole 25, a layer of a first cathode electrode material 28 is deposited on the entire substrate surface by oblique deposition. The oblique deposition is a technique of forming a film by deposition from a direction inclined at a predetermined angle relative to a rotational axis normal to the major substrate surface. The layer of the first cathode electrode material 28 is of e.g. molybdenum or tungsten and obliquely deposited on the gate electrode layer 23 to form a reverse taper in cross-section above the hole 25. At the same time that the layer of the first electrode material 28 is deposited on the gate electrode layer 23, a fraction **28*a* of the layer of the first cathode electrode material 28 is deposited on the bottom 25*b* of the hole 25**.

Figure 7:
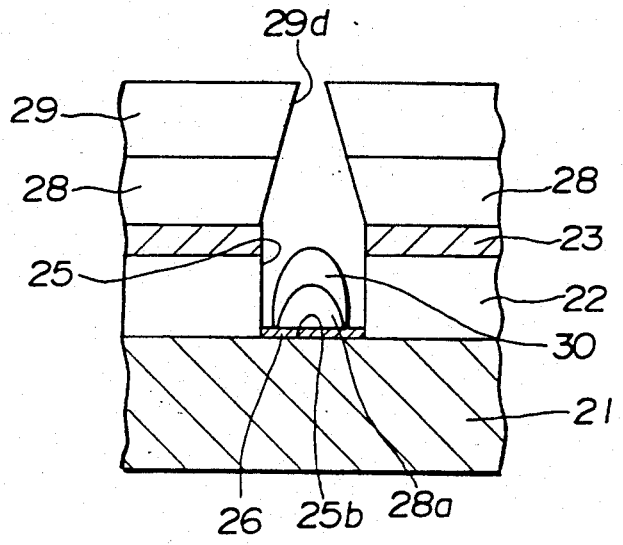
FIG. 7 is a cross-sectional view showing the method for producing the planar electron radiating device and showing the process up to the stage of formation of a layer of a second cathode electrode material.

Then, as shown in FIG. 7, a layer of a second cathode electrode material 29 of e.g. tungsten is formed on the entire substrate surface. At this time, the hole 25 is reduced in diameter by the layer of the first cathode electrode material 28, so that the layer of the second cathode electrode material 29 is deposited in a direction of reducing the diameter of the opening 25 to a narrower diameter **29*d*. The result is that a fraction of the layer of the second cathode electrode material 29 is deposited on the bottom 25*b* of the hole 25 in an area which becomes increasingly narrow with reduction in the size of the narrow opening 29*d*, so that ultimately a cathode 30 in the form of a cone having a pointed end is formed on the bottom 25*b***.

Figure 8:
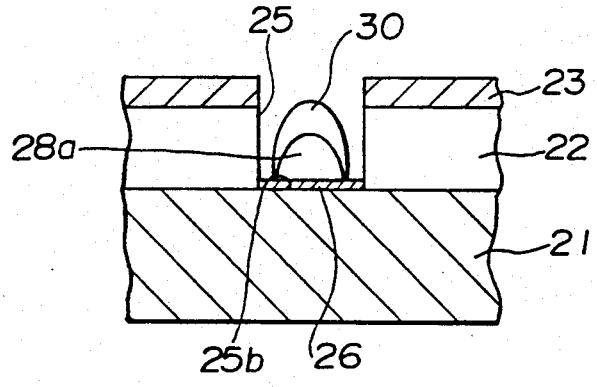
FIG. 8 is a cross-sectional view showing the method for producing the planar electron radiating device and showing the process up to the lift-off stage.

Then, as shown in FIG. 8, the layer of the first cathode electrode material 28 and the layer of the second electrode material 29 on the gate electrode layer 23 are removed by a lift-off method. Lift-off is carried out by ultrasonic washing using commonly used highly polar organic solvents, such as DMF (dimethylformamide) or acetone. The cathode 30 may be prevented from being detached because it is tightly bonded to the major substrate surface by the chromium thin film 26 as a tight metal bonding film. When producing the image display device later, the planar type electron radiating device is faced via a vacuum space by a front panel having an anode electrode and a phosphor layer stacked one on the other.

With the planar type electron radiating device of the present invention, produced by the above process, the cathodes are positively affixed on the major substrate surface by the tight bonding metal film formed to a thin thickness on the major substrate surface. The result is that the cathodes may be prevented from becoming detached during the production process to improve the production yield.

Although the chromium thin film is used in the present embodiment as the tight bonding metal film, it is also possible to use other thin metal films. Wet etching may also be used for forming the opening 25. Cathode electrode materials having equivalent properties to those shown in the above described embodiment may also be employed.

What is claimed is:

1. A method for producing a planar type electrode device including a substrate having a major surface on which a plurality of cathodes with pointed ends are formed, and a gate electrode having a plurality of holes in the vicinity of said cathodes, said method comprising the following steps:

forming a voltage supplying layer on the major surface of said substrate;

forming a metal bonding film on said voltage supplying layer; and depositing at least one layer of cathode electrode material on said metal bonding film, wherein said cathode electrode material differs from said metal bonding film.

2. A method as claimed in claim 1 wherein said tight metal bonding film is a chromium thin film.

3. A method as claimed in claim 2 wherein said metal bonding film is a chromium thin film of a thickness less than or equal to 500 Å.

4. A method as claimed in claim 2 wherein said metal bonding film is deposited by evaporation on the major surface.

5. A method as claimed in claim 2 wherein said metal bonding film is deposited by oblique evaporation on the major surface.

6. A method for producing a planar type electrode planar device including a substrate and a plurality of cathodes with pointed ends formed on a major surface of said substrate, and a gate electrode having a plurality of holes in the vicinity of said cathodes, said method comprising the steps of:

forming a silicon oxide film on said substrate, forming a gate electrode layer on said silicon oxide film, applying a resist layer on said gate electrode layer, developing said resist layer to form a patterned resist layer by selective exposure of said resist layer to light to form an opening for exposing a part of a surface of said gate electrode, etching said gate electrode layer and said silicon oxide film, using said patterned resist layer as a mask, for forming a hole in registration with said opening in said gate electrode layer and said silicon oxide film for exposing a part of said major surface of said substrate, applying a second resist layer on the entire surface of said major surface of said substrate for development by selective exposure to light to form a window for exposing a part of said major surface at the bottom of said hole, and forming a metal bonding film on said major surface by depositing a metal bonding film on said second resist layer on said major surface and removing said second resist layer until said metal bonding film is a selected thickness on said major surface at the bottom of said hole before depositing at least one layer of cathode electrode material on the entire surface of said major surface.

7. A method for producing a planar type electrode planar device including a substrate, a plurality of cathodes with pointed ends formed on a major surface of said substrate, and a gate electrode having a plurality of holes in the vicinity of said cathodes, said method comprising the steps of:

forming a chromium thin film on said major surface before depositing at least one layer of cathode electrode material on the entire surface of said major surface, depositing a first layer of a cathode electrode material on the entire surface of said substrate, depositing a second layer of a cathode electrode material on the entire surface of said substrate, and removing said first and second layers of cathode electrode material to form said cathodes on the bottom of said holes.

8. A method for producing a planar type electrode planar device including a substrate, a plurality of cathodes with pointed ends on a major surface of said substrate, and a gate electrode having a plurality of holes in the vicinity of said cathodes, said method comprising:

forming a chromium thin film on said major surface before depositing at least one layer of cathode electrode material on the entire surface of said major surface, depositing a first cathode electrode material layer on the entire surface of said substrate, depositing a second cathode electrode material layer on the entire surface of said substrate, and removing said first cathode electrode material layer and said second cathode electrode material layer by a lift-off method to form said cathodes on the bottom of said holes.

9. A method as claimed in claim 2, wherein said metal bonding film is a chromium film having a thickness of from 100 Å to 300 Å.

* * * * *